US007048030B1

(12) United States Patent
Eisele et al.

(10) Patent No.: US 7,048,030 B1
(45) Date of Patent: May 23, 2006

(54) METHOD OF MAKING A CASTING ASSEMBLY

(75) Inventors: Casee Michele Eisele, Mannheim (DE); Michael Dean Kollath, Dunkerton, IA (US); Robert Lee Wood, Jr., Waterloo, IA (US); Edwin Roy Kreis, Waterloo, IA (US); Michael Carl Harting, La Porte City, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/993,819

(22) Filed: Nov. 19, 2004

(51) Int. Cl.
*B22C 7/00* (2006.01)

(52) U.S. Cl. ..... 164/45; 164/35; 164/34; 164/516

(58) Field of Classification Search ..... 164/45, 164/35, 34, 516, 361, 235, 369
See application file for complete search history.

(56) References Cited

U.S. PATENT DOCUMENTS 4,289,191 A 9/1981 Myllymaki ..... 164/45
4,561,491 A 12/1985 Slack ..... 164/516
4,759,810 A * 7/1988 Jackson et al. ..... 156/64
4,773,466 A * 9/1988 Cannarsa et al. ..... 164/45
5,250,136 A * 10/1993 O'Connor ..... 156/272.2
5,505,250 A 4/1996 Jago ..... 164/516
6,390,681 B1 * 5/2002 Nakazeki et al. ..... 384/107

OTHER PUBLICATIONS

Bidwell, H.T., "Investment Casting Handbook," 8 pages.

* cited by examiner

*Primary Examiner*—Kevin Kerns
*Assistant Examiner*—I.-H. Lin

(57) ABSTRACT

A method of making an investment or lost foam casting assembly of a first part movable with respect to a second part includes making first and second separate wax or foam patterns of portions of the first part. Then, a third wax or foam pattern of the second part is made. Next, ceramic core pieces are made. At least one of the core pieces is mounted on the first pattern to form a subassembly. The subassembly is combined with the third pattern so that the core pieces maintain a separation between the third pattern and the first pattern. The first and second patterns are bonded together to trap the subassembly and to form a complete casting assembly.

17 Claims, 3 Drawing Sheets

FIG. 10
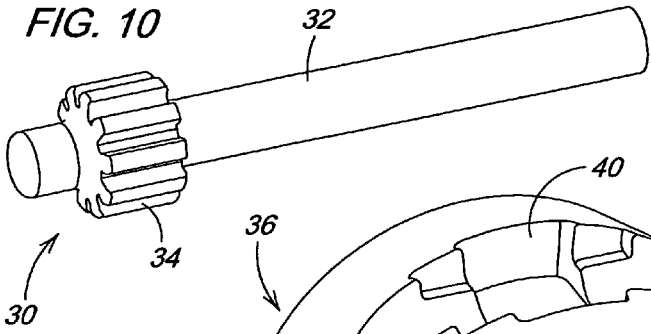
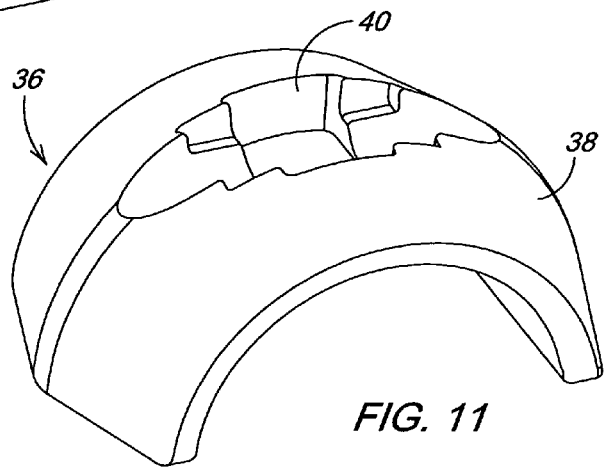
FIG. 11
FIG. 12
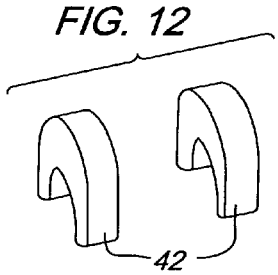
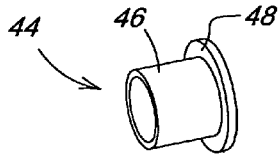
FIG. 13
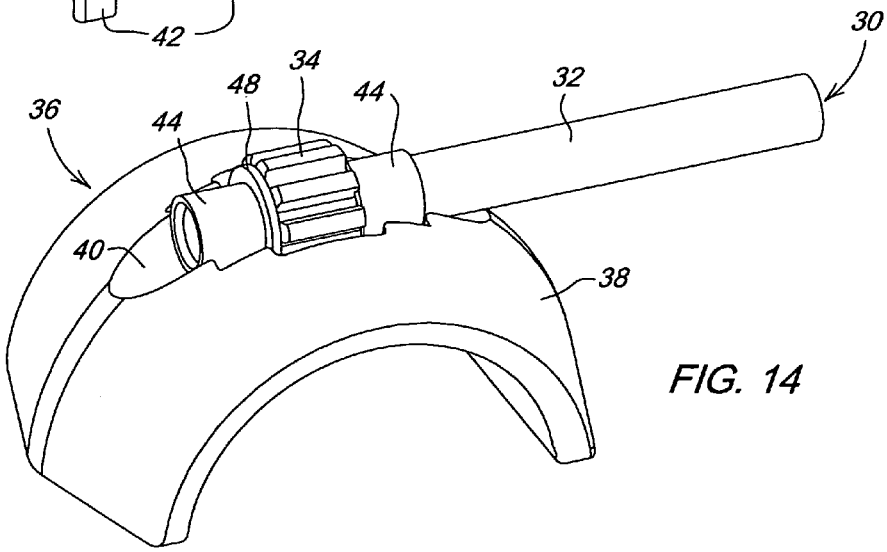
FIG. 14

METHOD OF MAKING A CASTING ASSEMBLY

BACKGROUND

The present invention relates to a method of making a casting part assembly for casting parts such as by an investment or lost foam casting process.

Some part assemblies with multiple cast parts have one cast part which is separate, but coupled to and movable with respect to a second cast part. Such an assembly may require that three separate parts be made by a lengthy casting process, then welding two of the parts together around the movable part. A simpler method of making such a part assembly is desired.

SUMMARY

Accordingly, an object of this invention is to provide a method of casting a multiple part assembly where one part is received by and movable with respect to a second part.

These and other objects are achieved by the present invention, which is a method of making a casting assembly of a first part movable with respect to a second part. First, first and second separate wax or foam patterns of portions of the first part are made. Then, a third wax or foam pattern of the second part is made. Next, ceramic core pieces are made. At least one of the core pieces is mounted on the first pattern to form a subassembly. The subassembly is combined with the third pattern so that the core pieces maintain a separation between the third pattern and the first pattern. The first and second patterns are bonded together to trap the subassembly and to form a complete casting assembly.

BRIEF DESCRIPTION OF THE DRAWINGS

FIGS. 10–12 are perspective views of patterns used with a second embodiment of the present invention;

FIG. 13 is a perspective view of the ceramic cores used with a second embodiment of the present invention;

FIGS. 14 and 15 are perspective views showing the steps of the second embodiment of the present invention.

DETAILED DESCRIPTION

Figure 1:
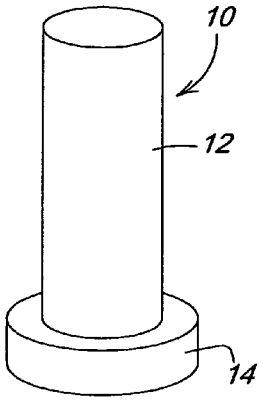
FIGS. 1–3 are perspective views of patterns used with a first embodiment of the present invention.

According to a first embodiment of the present invention, a wax or foam pattern 10 is formed as shown in FIG. 1. Pattern 10 is a portion of a first investment or lost foam cast part, and includes a cylindrical shaft 12 with a cylindrical ring 14 formed on one end thereof.

Figure 2:
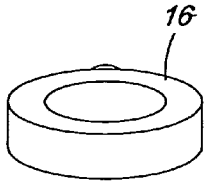

Another wax or foam pattern 16 is formed as shown in FIG. 2. Pattern 16 is a cylindrical wax or foam ring and comprises a remaining portion of the first part.

Figure 3:
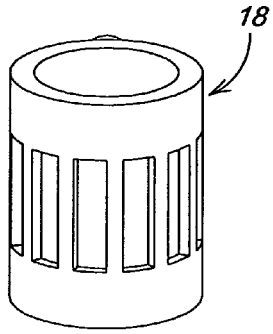

A wax or foam pattern 18 is formed as shown in FIG. 3. Pattern 18 is in the shape of the second part which is a hollow sleeve.

Figure 4:
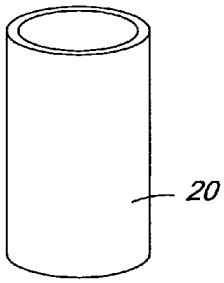
FIGS. 4 and 5 are perspective views of ceramic cores used with the first embodiment of the present invention.

A ceramic core 20 is formed as shown in FIG. 4. Ceramic core 20 is in the form of a hollow cylindrical sleeve.

Figure 5:
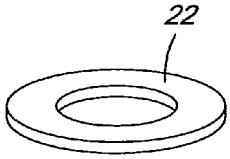

A pair of ceramic cores 22 are formed as shown in FIG. 5. Ceramic cores 22 are in the form of a hollow annular ring. In place of ceramic cores to separate parts, parts could be coated with a refractory coating which could be either sprayed on, brushed on, or dipped.

Figure 6:
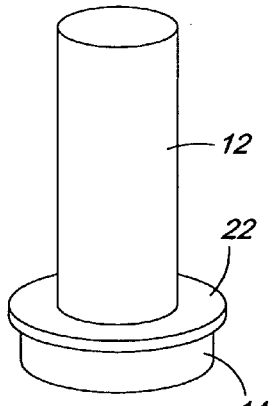
FIGS. 6–9 are perspective views showing the steps of the first embodiment of the present invention.
Figure 7:
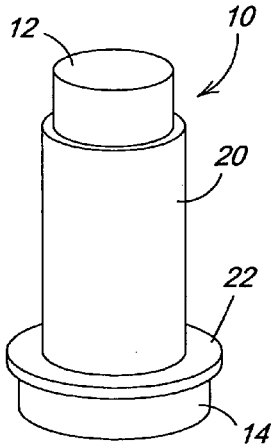
Figure 8:
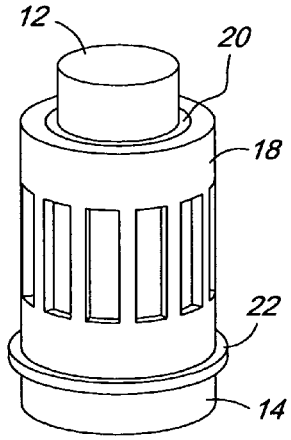
Figure 9:
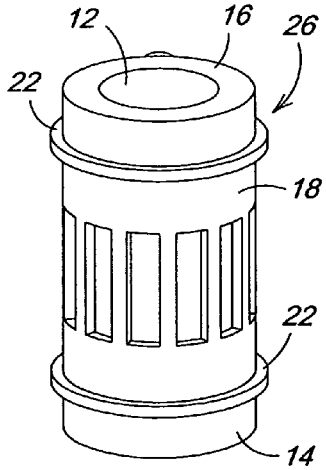

Referring now to FIG. 6, one of the cores 22 is mounted on the shaft 12 of pattern 10 next to ring 14. Next, as shown in FIG. 7, core 20 is mounted on the shaft 12 of pattern 10 next to core 22. Next, as shown in FIG. 8, pattern 18 is mounted over the core 20 with one end next to core 22. Finally, as shown in FIG. 9, another ceramic core ring 22 is mounted on the shaft 12 of pattern 10 next to the other end of core 20, and pattern ring 16 is bonded or attached, such as by gluing or wax or foam welding, to the upper end of shaft 12.

This results in an investment or lost foam casting assembly 26 wherein the patterns 10 and 16 of the first part are separate and spaced apart from the pattern 18 of the second part. This assembly 26 may then be used in a known standard investment or lost foam casting process, and the result will be a first inner metal or cast part received by and rotatable with respect to a second outer metal or cast part.

A second embodiment of the invention is illustrated by FIGS. 10–15 which relate to an investment casting assembly for a wheel sleeve assembly having a sleeve, a pinion and a retaining bracket.

A wax or foam pattern 30 is formed as shown in FIG. 10. Pattern 30 is a portion of a first investment or lost foam cast part, and includes a cylindrical shaft 32 with a gear piece 34 formed on one end thereof.

Another wax or foam pattern 36 is formed as shown in FIG. 11. Pattern 36 is a housing 38 which forms a slot or recess 40.

A pair of wax or foam patterns 42 are formed as shown in FIG. 12. Patterns 42 are in the shape of the U-shaped brackets.

A pair of ceramic ring cores 44 are formed as shown in FIG. 13. Ceramic cores 44 have a hollow cylindrical sleeve 46 with a flange 48 at one end.

Referring now to FIG. 14, the cores 44 are mounted on the shaft 32 of pattern 30 on either side of the gear piece 34 with flanges 48 next to the ends of the gear piece 34, and this subassembly is mounted in the recess 40 of pattern 36.

Figure 15:
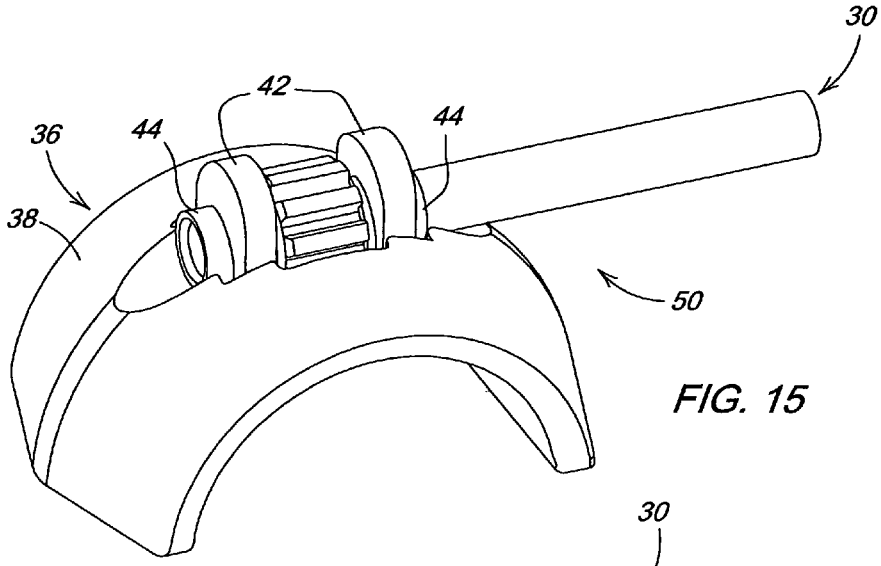

Next, as shown in FIG. 15, a wax or foam pattern 42 is mounted over each of the cores 44 and is glued to the pattern 36, trapping the pinion gear. This casting assembly 50 may then be coated, fired, poured, and cleaned as in the known standard investment casting process, or processed according to the known lost foam casting process. The result will be an inner metal shaft and gear part received by and rotatable with respect to a metal housing/bracket part. Each separate piece of the assembly 50 will require its own attachment point to a casting tree.

Figure 16:
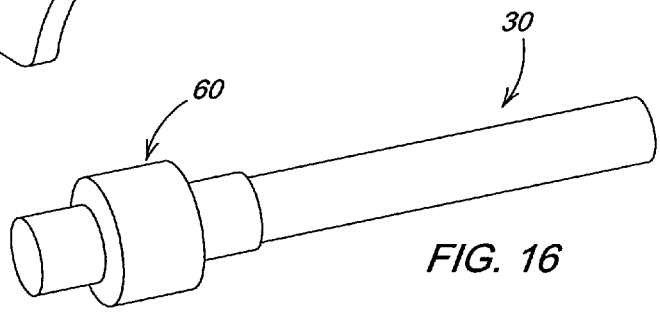
FIGS. 16 and 17 are perspective views relating to a third embodiment of the present invention.
Figure 17:
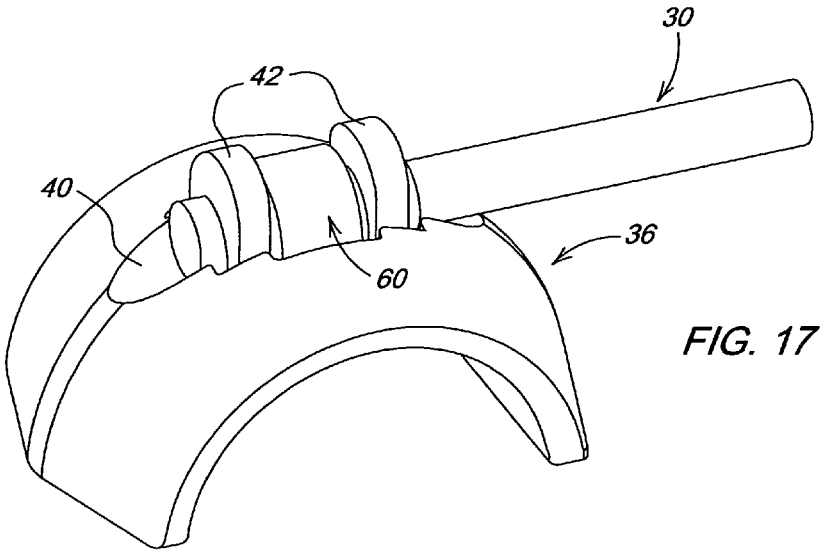

A third embodiment of the invention is illustrated by FIGS. 16 and 17 together with FIGS. 10, 11 and 12, and also relates to an investment or lost foam casting assembly for a wheel sleeve assembly having a sleeve, a pinion and a retaining bracket.

As in the second embodiment, a wax or foam pattern 30 is formed as shown in FIG. 10. Pattern 30 is a portion of a first cast part, and includes a cylindrical shaft 32 with a gear piece 34 formed on one end thereof.

Another wax or foam pattern 36 is formed as shown in FIG. 11. Pattern 36 is a housing 38 which forms a slot or recess 40.

A pair of wax or foam patterns 42 are formed as shown in FIG. 12. Patterns 42 are in the shape of the U-shaped brackets.

Then, the gear piece 34 and the portions of shaft 32 next to gear piece 34 are coated with a ceramic coating 60 as shown in FIG. 16.

Referring now to FIG. 17, the subassembly of FIG. 16 is mounted in the recess 40 of pattern 36, and the patterns 42 are glued or wax-welded to the pattern 36 so as to trap a portion of pattern 30 and ceramic coating 60 therebetween.

The third embodiment also produces an investment or lost foam casting assembly wherein the wax or foam pattern 30 of a first part is separate and spaced apart from the wax or foam patterns 36 and 42 of the second part. When these patterns are replaced by metal during the investment or lost foam casting process, the result will be an inner metal shaft and gear part received by and rotatable with respect to a metal housing/bracket part.

Thus, an investment or lost foam cast assembly with loose pieces is made with ceramic cores and patterns which are glued or wax or foam welded together. The loose piece is fitted with pre-formed ceramic cores or should be partially coated before assembly. This new process will allow assemblies to be formed earlier in the process, thereby shortening lead times. It will also eliminate strength concerns that are caused by other assembly methods, such as fasteners, welding, etc.

With this method, the assembly operations can be performed on patterns which can be much lighter than the cast metal parts would be. This avoids a need for special lifting equipment, fixtures, etc. For example, if a very light foam pattern will become a 100 lb. iron part, the assembly could be easily done by hand with the present invention, whereas traditional processes would involve handling the 100 lb. part while assembling other pieces.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A method of making a casting assembly for casting a first part movable with respect to a second part, comprising:
- making first and second separate patterns of portions of the first part;
- making a third pattern of the second part;
- making a plurality of ceramic core pieces; and
- mounting at least one of the core pieces on the first pattern to form a subassembly;
- combining the subassembly with the third pattern so that the core pieces maintain a separation between the third pattern and the first pattern;
- attaching the first and second patterns together to trap the third pattern and form a complete casting assembly.

2. The method of claim 1, wherein:
- the third pattern is hollow; and
- the subassembly is received by and inserted through the third pattern.

3. The method of claim 1, wherein:
- the at least one of the core pieces is hollow and receives the first pattern;
- the third pattern is hollow; and
- the at least one of the core pieces and the first pattern are received by the third pattern.

4. The method of claim 1, wherein:
- the patterns are formed out of wax and the assembly is used in an investment casting process.

5. A method of making a casting assembly for casting a first part movable with respect to a second part, comprising:
- making first and second separate patterns of portions of the first part;
- making a third pattern of the second part;
- making a plurality of ceramic core pieces;
- mounting at least one of the core pieces on the first pattern to form a subassembly;
- combining the subassembly with the third pattern so that the core pieces maintain a separation between the third pattern and the first pattern; and
- attaching the first and second patterns together to trap the third pattern and form a complete casting assembly, and the patterns are formed out of foam and the assembly is used in a lost foam casting process.

6. A method of making a casting assembly for casting a first part movable with respect to a second part, comprising:
- making a first pattern of the first part;
- making a second pattern of a first portion of the second part;
- making separate third pattern of another portion of the second part;
- making at least one ceramic core pieces;
- mounting the core piece on the first pattern to form a subassembly;
- combining the subassembly with the second pattern so that the core pieces maintain a separation between the second pattern and the first pattern; and
- bonding the third pattern to the second pattern and around the subassembly to trap the subassembly and form a complete casting assembly.

7. The method of claim 6, characterized by:
- openings are formed between the second pattern and the third pattern, and the subassembly is received by said openings.

8. The method of claim 6, wherein:
- the patterns are formed out of wax and the assembly is used in an investment casting process.

9. A method of making a casting assembly for casting a first part movable with respect to a second part, comprising:
- making a first pattern of the first part;
- making a second pattern of a first portion of the second part;
- making separate third pattern of another portion of the second part;
- making at least one ceramic core pieces;
- mounting the core piece on the first pattern to form a subassembly;
- combining the subassembly with the second pattern so that the core pieces maintain a separation between the second pattern and the first pattern; and
- bonding the third pattern to the second pattern and around the subassembly to trap the subassembly and form a complete casting assembly, and the patterns are formed out of foam and the assembly is used in a lost foam casting process.

10. A method of making a casting assembly for casting a first part movable with respect to a second part, comprising:
- making a first pattern of the first part;
- making a second pattern of a first portion of the second part;
- making separate third and fourth patterns of other portions of the second part;
- making a pair of ceramic core pieces;

mounting the core pieces on the first pattern to form a subassembly;

combining the subassembly with the second pattern so that the core pieces maintain a separation between the second pattern and the first pattern; and bonding the third and fourth patterns to the second pattern and around the subassembly to trap the subassembly and form a complete casting assembly.

11. The method of claim 10, characterized by:

openings are formed between the second pattern and the third and fourth patterns, and the subassembly is received by said openings.

12. The method of claim 10, wherein:

the patterns are formed out of wax and the assembly is used in an investment casting process.

13. A method of making a casting assembly for casting a first part movable with respect to a second part, comprising:

making a first pattern of the first part;

making a second pattern of a first portion of the second part;

making separate third and fourth patterns of other portions of the second part;

making a pair of ceramic core pieces;

mounting the core pieces on the first pattern to form a subassembly;

combining the subassembly with the second pattern so that the core pieces maintain a separation between the second pattern and the first pattern; and bonding the third and fourth patterns to the second pattern and around the subassembly to trap the subassembly and form a complete casting assembly, and the patterns are formed out of foam and the assembly is used in a lost foam casting process.

14. A method of making a casting assembly for casting a first part movable with respect to a second part, comprising:

making a first pattern of the first part;

making a second pattern of a first portion of the second part;

making separate third pattern of another portion of the second part;

coating at least a portion of the first pattern with a ceramic coating;

combining the coated first pattern with the second pattern so that the ceramic coating maintains a separation between the second pattern and the first pattern; and bonding the third pattern to the second pattern and around the subassembly to trap the subassembly and form a complete casting assembly.

15. The method of claim 14, characterized by:

an opening is formed between the second pattern and the third pattern, and the coated first pattern is received by said opening.

16. The method of claim 14, wherein:

the patterns are formed out of wax and the assembly is used in an investment casting process.

17. A method of making a casting assembly for casting a first part movable with respect to a second part, comprising:

making a first pattern of the first part;

making a second pattern of a first portion of the second part;

making separate third pattern of another portion of the second part;

coating at least a portion of the first pattern with a ceramic coating;

combining the coated first pattern with the second pattern so that the ceramic coating maintain a separation between the second pattern and the first pattern; and bonding the third pattern to the second pattern and around the subassembly to trap the subassembly and form a complete casting assembly, and the patterns are formed out of foam and the assembly is used in a lost foam casting process.

* * * * *